US009199706B2

(12) United States Patent
Kinoshita

(10) Patent No.: US 9,199,706 B2
(45) Date of Patent: Dec. 1, 2015

(54) WATER RESCUE DEVICE

(71) Applicant: AERO FACILITY CO., LTD., Tokyo (JP)

(72) Inventor: Motomi Kinoshita, Tokyo (JP)

(73) Assignee: AERO FACILITY CO., LTD., Tokyo (JP)

( * ) Notice: Subject to any disclaimer, the term of this patent is extended or adjusted under 35 U.S.C. 154(b) by 0 days.

(21) Appl. No.: 14/236,624

(22) PCT Filed: Nov. 20, 2012

(86) PCT No.: PCT/JP2012/080055
§ 371 (c)(1),
(2) Date: Feb. 1, 2014

(87) PCT Pub. No.: WO2013/084715
PCT Pub. Date: Jun. 13, 2013

(65) Prior Publication Data

US 2014/0170914 A1 Jun. 19, 2014

(30) Foreign Application Priority Data

Dec. 5, 2011 (JP) ..... 2011-266343
Jul. 1, 2012 (JP) ..... 2012-148083

(51) Int. Cl.
*B63B 35/81* (2006.01)
*B63C 9/15* (2006.01)
(Continued)

(52) U.S. Cl.
CPC ..... *B63C 9/01* (2013.01); *B63B 22/003* (2013.01); *B63C 9/26* (2013.01); *B63C 9/08* (2013.01); *B63C 9/18* (2013.01); *B63C 9/23* (2013.01); *B63C 2009/0082* (2013.01)

(58) Field of Classification Search
CPC ..... B63C 9/01; B63C 9/00; B63C 2009/0023
USPC ..... 441/82, 83, 92–99; 405/68, 69
See application file for complete search history.

(56) References Cited

U.S. PATENT DOCUMENTS 3,664,504 A * 5/1972 Ayers et al. ..... 210/776
3,819,011 A * 6/1974 Kinase et al. ..... 182/48
(Continued)

FOREIGN PATENT DOCUMENTS

JP H05-000599 U 1/1993
JP H05-178285 A 7/1993
(Continued)

OTHER PUBLICATIONS

International Search Report for PCT/JP2012/080055, Feb. 26, 2013.
(Continued)

*Primary Examiner* — S. Joseph Morano
*Assistant Examiner* — Andrew Polay

(57) ABSTRACT

When carrying out a water emergency rescue, to rescue, particularly from a helicopter, a plurality of victims in a wide area of water without any drowning occurring. [Solution] A water rescue device is formed from: a hollow tube-shaped air chamber which is stored in an evacuated state; a gas injection mechanism which injects a pressurized gas in the air chamber; a pressurized gas tank which retains the pressurized gas; and a case which houses the air chamber, the gas injection mechanism, and the pressurized gas tank. When the case is lowered upon a water surface from a helicopter, the pressurized gas in the pressurized gas tank is injected via the gas injection mechanism into the air chamber, and the air chamber is released from the case, expanded in a swirl shape, and deployed on the water surface.

6 Claims, 8 Drawing Sheets

(51) Int. Cl.

| | |
|---|---|
| ***B63C 9/01*** | (2006.01) |
| ***B63B 22/00*** | (2006.01) |
| ***B63C 9/26*** | (2006.01) |
| *B63C 9/00* | (2006.01) |
| *B63C 9/08* | (2006.01) |
| *B63C 9/18* | (2006.01) |
| *B63C 9/23* | (2006.01) |

(56) References Cited

U.S. PATENT DOCUMENTS

| | | | | |
|---|---|---|---|---|
| 4,216,535 | A | 8/1980 | Bennett | |
| 5,197,821 | A * | 3/1993 | Cain et al. | 405/68 |
| 5,346,329 | A * | 9/1994 | Goans et al. | 405/68 |
| 5,374,211 | A | 12/1994 | Imazato | |
| 5,690,524 | A | 11/1997 | Salvemini | |
| 5,820,431 | A | 10/1998 | Biesecker | |
| 2009/0145854 | A1 * | 6/2009 | Pinheiro de Andrade | 210/747 |
| 2010/0150655 | A1 | 6/2010 | Kilvert | |

FOREIGN PATENT DOCUMENTS

| | | | |
|---|---|---|---|
| JP | H06-211185 | A | 8/1994 |
| JP | 2001-141400 | A | 5/2001 |
| JP | 2004-122967 | A | 4/2004 |

OTHER PUBLICATIONS

Korean Intellectual Property Office, Office Action for Korean Patent Application No. 10-2014-7001035, Dec. 26, 2014.

Canadian Intellectual Property Office, Office Action for Canadian Patent Application No. 2,856,032, Jun. 4, 2015.

European Patent Office, Extended European Search Report for EP Patent Application No. 12855475.5 , Jul. 21, 2015.

* cited by examiner

WATER RESCUE DEVICE

TECHNICAL FIELD

The present invention relates to a water rescue device used to save human lives on the water from a helicopter or the like, and more particularly to a water rescue device which allows lifesaving in a wide area.

BACKGROUND ART

In recent years, aircraft and ships have been growing in size. Consequently, once an accident occurs, there can be a large number of victims. In particular, if an accident occurs on, in, or above a sea, lake, river or the like, there can be a large number of people who need to be rescued (hereinafter referred to as rescuees). Besides, swollen rivers and inundated regions caused by a natural disaster such as a heavy rain, typhoon, tsunami, or the like also produce rescuees. A search and rescue operation by a helicopter from the sky is especially effective in saving such rescuees.

Therefore, a rescue method has conventionally been available, as described in Patent Literature 1, in which a rope is thrown from a helicopter, allowing a rescuee to catch the rope, and a rescuer approaches the rescuee by water or descends from the helicopter to save the rescuee. Also, there is a method, as described in Patent Literature 2, which involves dropping a circular escape bag containing a rescue net thereinside from a helicopter and saving any rescuee caught in the rescue net.

However, there is a problem that with either method, coverage of rescue operations is extremely limited, and when there is a severe storm or high waves, it is very difficult to drop a rope or escape bag in a rescuable range for rescuees, making it sometimes impossible for the rescuee to reach the rescue device, and consequently rendering the rescue device useless.

CITATION LIST

Patent Literature

Patent Literature 1: Japanese Patent Laid-Open No. 2004-122967

Patent Literature 2: Japanese Patent Laid-Open No. 5-178285

SUMMARY OF INVENTION

Technical Problem

The problem to be solved is the difficulty to deploy a rescue device to save rescuees on the water in a large area from a helicopter or the like during a rescue operation in a water accident.

Solution to Problem

The present invention is a water rescue device intended to solve the above problem, comprising: a hollow tubular air chamber configured to become spiral when filled with gas; a gas filling mechanism adapted to fill the gas into the air chamber; and a compressed gas cylinder adapted to compress and hold the gas, wherein the compressed gas from the compressed gas cylinder is filled into the air chamber by the gas filling mechanism, unfolding the air chamber into a spiral shape such as an Archimedean spiral. Consequently, the air chamber, which becomes spiral-shaped when filled with gas, can be deployed over a wider area on the water surface than an annular or linear one.

The present invention further comprises a casing adapted to house the air chamber, the gas filling mechanism, and the compressed gas cylinder, wherein the air chamber is released from the casing when the casing is dropped onto a water surface. Consequently, the water rescue device can be made ready for use by simply dropping the casing containing necessary mechanisms.

According to another embodiment, the present invention further comprises: a plurality of independent air chambers; and a connecting member adapted to connect the plurality of independent air chambers with each other. This reduces the size of individual air chambers and thereby reduces gas filling time.

Advantageous Effect of Invention

The water rescue device according to the present invention has the advantage of being able to reliably save rescuees because the air chamber can be deployed over a wider area and brought close to the rescuees even in a stormy weather, allowing the rescuees to cling to the air chamber for increased buoyancy and wait for a full-scale rescue operation without drowning.

DESCRIPTION OF EMBODIMENTS

Figure 1:
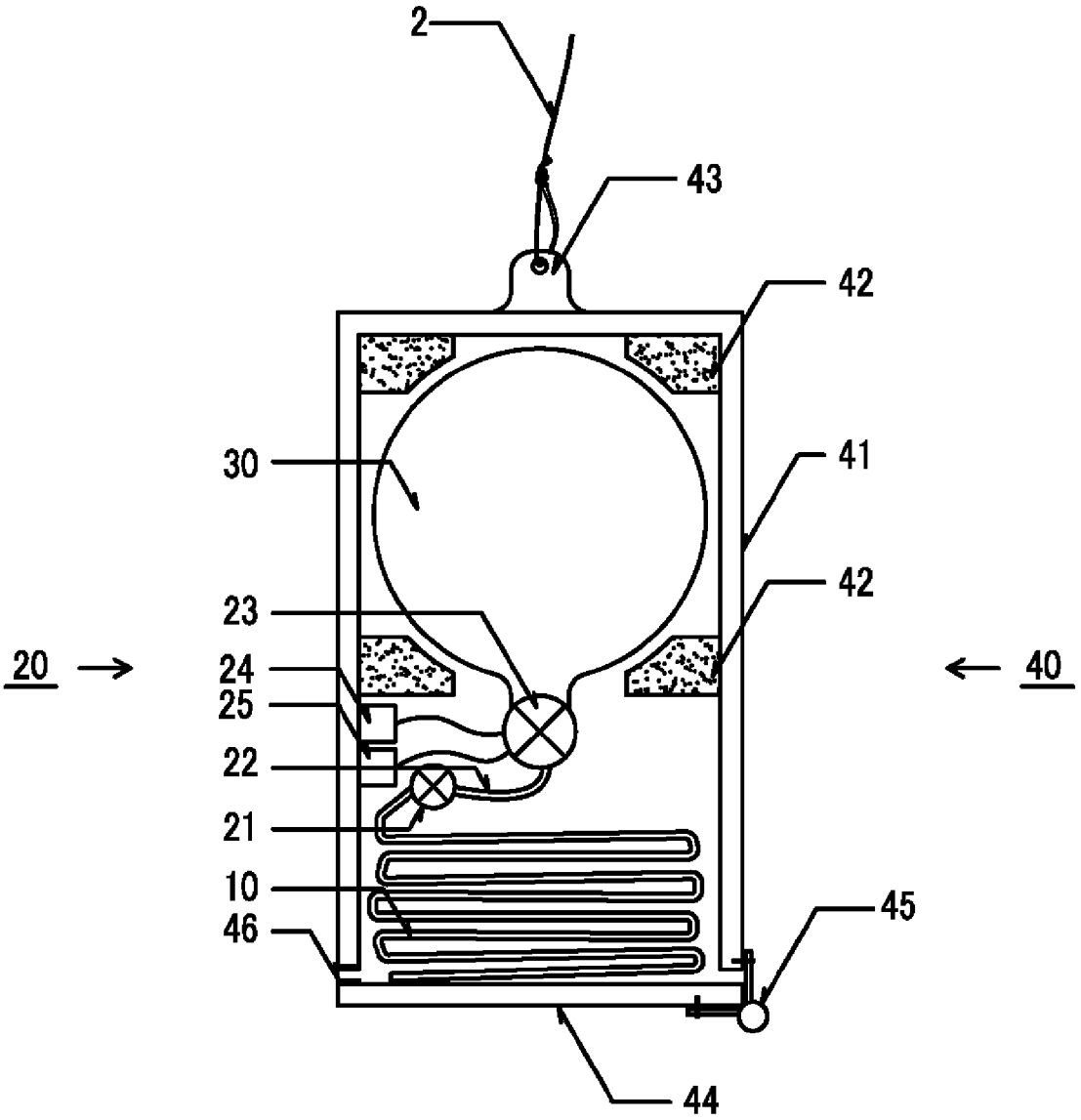
FIG. 1 is a configuration diagram of a water rescue device according to a first embodiment of the present invention.

A first embodiment of the present invention will be described with reference to drawings. FIG. 1 is a configuration diagram of a water rescue device 1 according to the first embodiment of the present invention, where the water rescue device 1 includes an air chamber 10, a gas filling mechanism 20, a compressed gas cylinder 30, and a casing 40.

In FIG. 1, the air chamber 10 is evacuated, folded, and housed in the casing 40. The air chamber 10 is made of a polymer (fiber, resin, or rubber) film. When inflated by being filled with gas, the air chamber 10 has a hollow tubular shape with a substantially circular cross section and without a partition. When inflated, the air chamber 10 is formed into a spiral shape made up of plural linear portions 11*a* to 11*x* joined together. Desirably, the spiral is shaped as an Archimedean spiral in which spiral lines are spaced evenly with each other. The Archimedean spiral is approximated by line segments as appropriate to form the air chamber 10. For example, one circle (360 degrees) is approximated by about eight linear portions. Note that the method for approximation is not limited to this. Near the center of the Archimedean spiral, in particular, a simpler approximation is used because a high level of approximation by straight lines complicates the shape too much.

Regarding the polymeric material of air chamber 10, polyurethane resin (polyurethane rubber) is excellent in terms of strength and the like, but this is not restrictive.

Also, the linear portions 11 of the air chamber 10 are formed using a known technique, for example, by joining two pieces of planar polymer film by a high-frequency welding process. Furthermore, by joining the linear portions of the air chamber 10 with each other at a section with an equal angle to an axial direction of the linear portion (congruent elliptic portions), the air chamber 10 can be formed into a desired shape so as to be maintained in a desired shape when inflated. Incidentally, the material and manufacturing method of the air chamber 10 as well as the method for approximating the spiral shape are not limited to those described above, and reinforcing members may be added and the material and thickness of the polymer film may be changed.

As shown in FIG. 1, one end (terminal side of the spiral) of the air chamber 10 is sealed. On the other hand, another end (central side of the spiral) of the air chamber 10 is provided with a gas filling mechanism 20. The gas filling mechanism 20 includes a check-valve 21 installed on a flow path leading to the air chamber 10, a solenoid valve 23 installed on the side of the compressed gas cylinder 30, an air line 22 interconnecting the check-valve 21 and the solenoid valve 23, and a battery 24 adapted to actuate the solenoid valve 23. The check-valve 21 here does not require any power in particular, and passes a fluid only in one direction. The solenoid valve 23 is normally closed, and opens the flow path by operating a solenoid when energized by the battery 24.

Furthermore, the gas filling mechanism 20 includes a signal receiver 25 adapted to receive an external command signal for opening/closing the solenoid valve 23, where the signal receiver 25 is wired to the solenoid valve 23.

The compressed gas cylinder 30, which is adapted to contain a compressed gas, is constructed using a shape and material capable of withstanding high pressures. Desirably, compressed air is sealed therein as the compressed gas.

The casing 40 includes a cylinder 41 made of a thin steel sheet with its one end open, and a cover 44 adapted to close the open end. The folded air chamber 10, the gas filling mechanism 20, and the compressed gas cylinder 30 are housed in the casing 40. Seats 42 are provided in the casing 40 to fix the compressed gas cylinder 30.

Also, a metal fitting 43 adapted to fix a holding rope 2 is installed outside the bottom of the cylinder 41 of the casing 40. Furthermore, at the open end of the cylinder 41 of the casing 40, the cover 44 is held by a hinge 45 and a magnetic catch 46, where the hinge 45 is adapted to pivotally connect the cover 44 to the cylinder 41 and the magnetic catch 46 is adapted to openably and closably lock the cover 44 onto the cylinder 41.

Figure 2A:
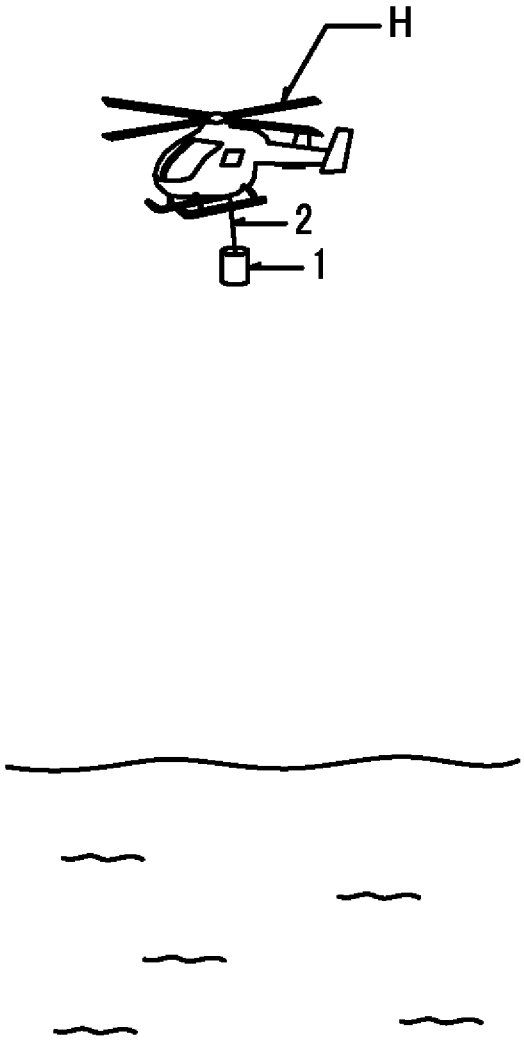
FIG. 2A is an operation explanation diagram of the water rescue device according to the first embodiment of the present invention.
Figure 2B:
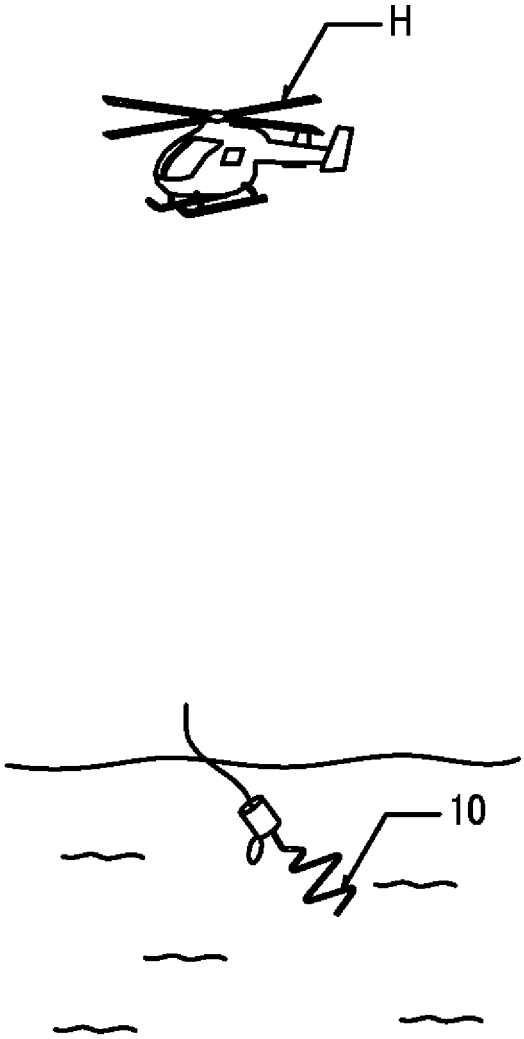
FIG. 2B is an operation explanation diagram of the water rescue device according to the first embodiment of the present invention.
Figure 2C:
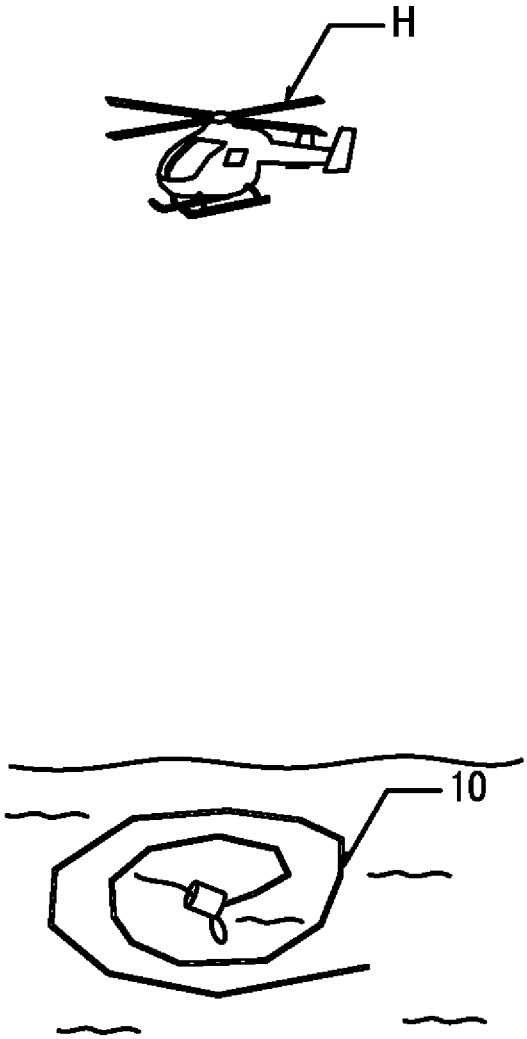
FIG. 2C is an operation explanation diagram of the water rescue device according to the first embodiment of the present invention.

Operation of the water rescue device with this configuration will be described with reference to drawings. FIGS. 2A to 2C are operation explanation diagrams according to the first embodiment of the present invention. The water rescue device 1 is caused to descend into the air by being suspended by the holding rope 2 from a helicopter H as shown in FIG. 2A, and then dropped by removing the holding rope 2 from the helicopter H as shown in FIG. 2B. When the water rescue device 1 reaches the water surface, the air chamber 10 is pushed out of the water rescue device 1, and the air chamber 10 filled with gas is unfolded into a spiral shape on the water surface as shown in FIG. 2C.

The operation of the water rescue device will be described in more detail with reference to FIGS. 2A, 2B, and 2C. When the water rescue device 1 is mounted on the helicopter H, the air chamber 10 is folded and is housed in the casing 40 together with the gas filling mechanism 20 and the compressed gas cylinder 30. Furthermore, the casing 40 is mounted inside the helicopter H and connected to the helicopter H via the holding rope 2. When the helicopter H arrives at a location over the site in need of the water rescue device, the casing 40 is lowered by a distance equal to the length of the holding rope 2. Alternatively, instead of being mounted inside the helicopter H, the casing 40 may be carried by being suspended from the holding rope 2.

When the holding rope 2 is disconnected from the helicopter H with the casing 40 being suspended, the casing 40 drops toward the water surface.

When the casing 40 reaches the water surface, a signal to open the solenoid valve 23 is sent to the signal receiver 25 by radio communication and the solenoid valve 23 is actuated by the signal and power of a battery 24, opening the flow path, where the signal is either issued manually by the crew or issued automatically according to a predetermined condition. Consequently, the compressed gas in the compressed gas cylinder 30 starts to flow to the air line 22. The check-valve 21 is installed at a tip of the air line 22, and the gas flowing in this direction flows into the air chamber 10 without being checked by the check-valve 21 as in the forward direction.

Consequently, the air chamber 10 starts to inflate. The inflating air chamber 10 applies outward pressure to the cover 44 of the casing 40, and when the pressure exceeds holding power of the magnetic catch 46, the cover 44 opens by pivoting on the hinge 45. Consequently, the air chamber 10 is pushed out of the casing 40 and continues to inflate further.

Figure 3:
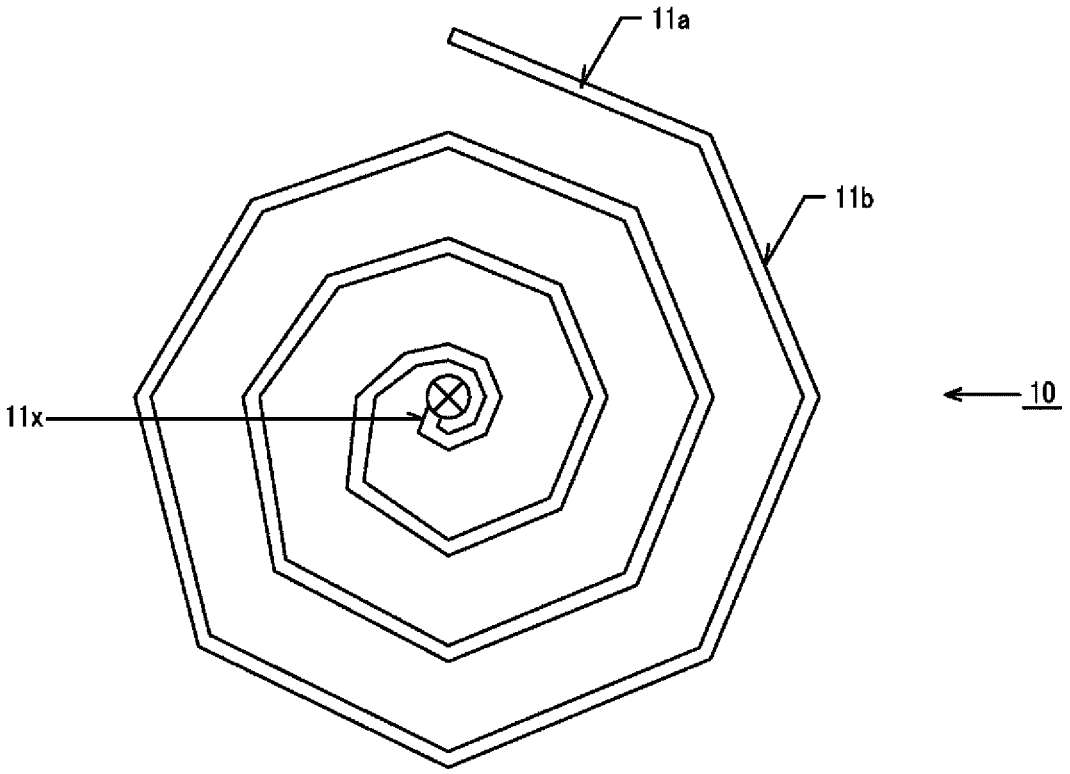
FIG. 3 is a plan view of an air chamber of the water rescue device according to the first embodiment of the present invention.

As shown in FIG. 3, the air chamber 10 is shaped to be approximated by an Archimedean spiral when inflated. When filled with a predetermined volume of gas from the compressed gas cylinder 30, the air chamber 10 shaped to be similar to an Archimedean spiral is deployed on the water surface.

The check-valve 21 installed in the flow path leading to the air chamber 10 prevents the gas from flowing backward from the air chamber 10 to the air line 22, and thereby keeps the air chamber 10 inflated.

In this state, since the spiral line is spaced almost evenly, with the inflated air chamber 10 deployed in an extensive area on the water surface, the rescuees can reach the air chamber 10 if they move approximately half the spacing of the spiral line at the maximum by swimming or the like. Even if the rescuees do not swim, it is conceivable that they will reach the air chamber 10 with the rescuees themselves or the water rescue device being carried by waves. Then, the rescuees can increase buoyancy by clinging to the air chamber 10. In this way, the rescuees can maintain their strength until an eventual rescue operation without drowning and increase the probability of being saved.

The air chamber 10 is floating on the water surface in an inflated state by being accompanied with the gas filling mechanism 20, the compressed gas cylinder 30, and the casing 40. Thus, after the water rescue device is used, the air chamber 10 can be recovered, as it is, for reuse. However, if airtightness of the air chamber 10 can be maintained, all or part of the gas filling mechanism 20, the cylinder 30, and the casing 40 may be configured to be separable from the air chamber 10. This will further increase the buoyancy of the air chamber 10, making it possible to save a larger number of rescuees although it will become difficult to reuse the air chamber 10.

Also, although it has been stated that the water rescue device 1 is connected to the helicopter H via the holding rope 2 before being dropped onto the water surface, the casing 40 may be dropped directly without using the holding rope 2 from the beginning. This can simplify the mechanism.

Also, although it has been stated that alternatively the water rescue device 1 is dropped by removing the holding rope 2 from the helicopter H, the water rescue device 1 may be lowered to the water surface while being held by the holding rope 2 as long as the flight of the helicopter H is not endangered. This will make it possible to reliably place the water rescue device at a desired position.

Figure 4A:
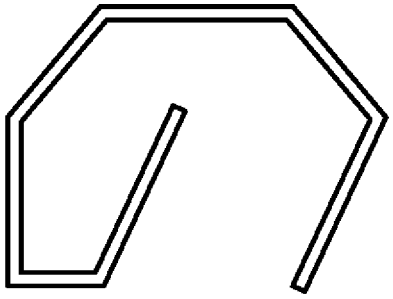
FIG. 4A is another plan view of an air chamber of the water rescue device according to the first embodiment of the present invention.
Figure 4B:
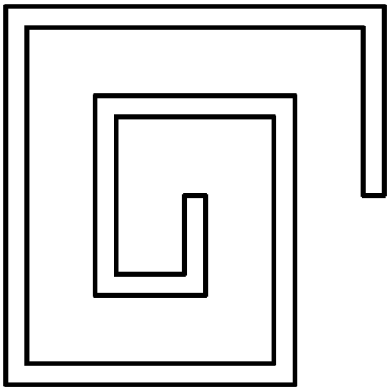
FIG. 4B is another plan view of an air chamber of the water rescue device according to the first embodiment of the present invention.

The spiral shape of the air chamber 10 may be not only an exact spiral shape, but also a shape made up of linear portions approximating a spiral or a shape similar to a spiral. Other examples of the spiral shape include, but are not limited to, a shape similar to a lower-case "e" such as shown in FIG. 4A and a square spiral such as shown in FIG. 4B. The shape can be selected by taking into consideration the size of the deployment area, ease of a production method, and various other points.

Although it has been stated that the air chamber 10 is housed in the casing 40 in a folded state, depending on the structure and manufacturing method of the air chamber 10, the air chamber 10 may be housed in a coiled state without being folded. This sometimes may allow good storage conditions to be maintained.

The casing 40 may have any internal structure and component as long as the casing 40 can contain the air chamber 10, the gas filling mechanism 20, and the compressed gas cylinder 30 and can release them as required. Also, the material is not limited to a thin steel sheet, and any material such as another metal, plastic, or cloth may be used as long as contents can be held securely during storage or transit.

The mechanism for opening the casing 40 to inflate the air chamber 10 is not limited to the mechanism which detaches the magnetic catch as the air chamber 10 inflates, and any method may be used, including another catch mechanism such as a ball catch, a latch mechanism, a mechanism configured to open the casing when part of the casing formed to have low strength is broken by a shock, or a mechanism configured to open the casing when part of the casing dissolves or falls in strength by getting wet.

Figure 5:
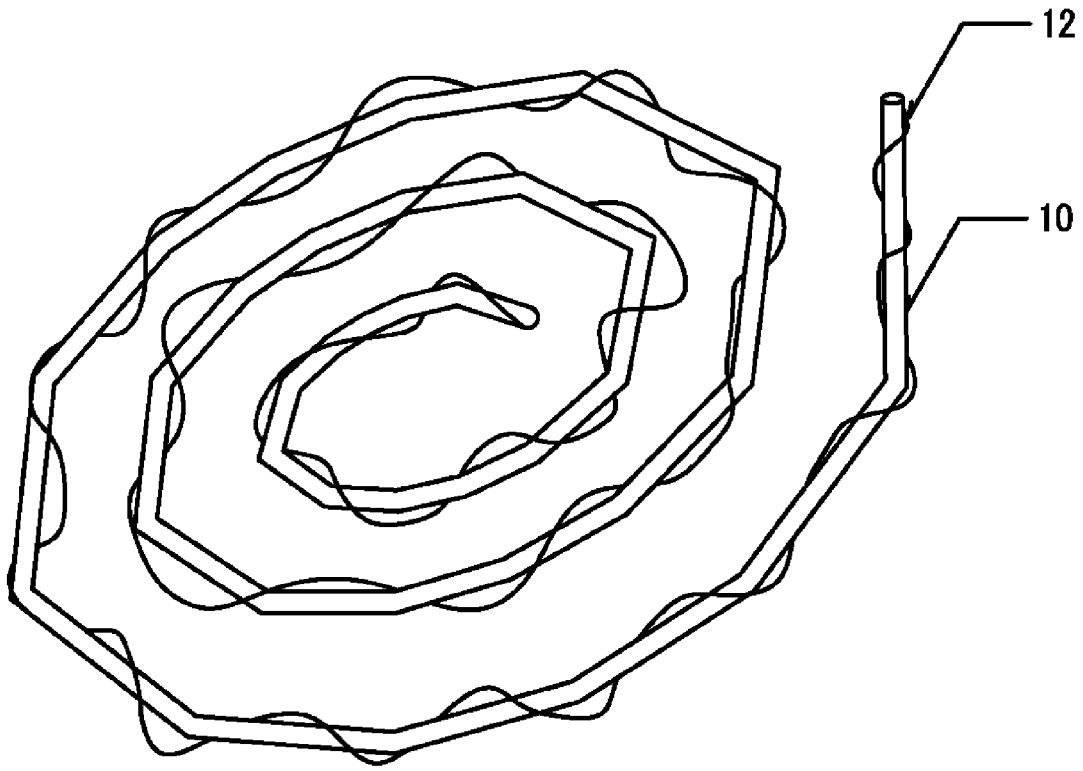
FIG. 5 is a configuration diagram of additional part of the water rescue device according to the first embodiment of the present invention.

Furthermore, as shown in FIG. 5, a thin string 12 may be attached beforehand to an outer periphery of the air chamber 10 as a handhold for rescuees. This will increase rescue efficiency although the structure of the air chamber 10 will become complicated. Also, without limiting to a thin string, handles or the like capable of supporting the rescuees may be provided.

The compressed gas is not limited to air, and may be another gas which is low in explosion risk and toxicity. For example, inert gas such as nitrogen or helium may be used as well. The inert gas, which does not contain impurities, does not cause ice formation, unlike air. Liquefied carbon dioxide may be used alternatively. Although measures need to be taken against possible formation of dry ice during filling, the liquefied carbon dioxide, which can reduce the size of the compressed gas cylinder thanks to high compressibility as a result of liquefaction, is effective in downsizing the entire water rescue device.

Although it has been stated that to fill the air chamber 10 with gas from the compressed gas cylinder 30, the gas filling mechanism 20 made up of the check-valve 21, the solenoid valve 23, and the air line 22 adapted to interconnect the check-valve 21 and the solenoid valve 23 is provided, the check-valve 21 and the solenoid valve 23 may be interconnected directly by omitting the air line 22, or the check-valve 21 and the solenoid valve 23 may be combined into a single valve having the functions of the two valves. This is effective in downsizing the device.

Although it has been stated that one gas filling mechanism 20 is installed on the end at the center of the spiral of the air chamber 10, the gas filling mechanism 20 may be installed at an end opposite the end at the center of the spiral. Also, the gas filling mechanism 20 may be installed at each end of the spiral of the air chamber 10. When the gas filling mechanisms 20 are installed at both ends, the time required for gas filling can be reduced.

Also, although it has been stated that the air chamber 10 is constructed as a single space without any partition, the air chamber 10 may be partitioned into plural spaces (small air chambers). In that case, either the gas filling mechanism 20 may be installed for each small air chamber, or the gas may be filled into respective small air chambers from a single gas filling mechanism 20 via a common flow path and respective check-valves. Consequently, even if the film material of the small air chambers is damaged, resulting in gas leakage, the leakage is confined to part of the small air chambers, making it possible to avoid a total loss of buoyancy.

Although it has been stated in the above description that the solenoid valve 23 is actuated by a radio signal and a battery, when the casing 40 is lowered to the water surface by the holding rope 2, electric power and signals may be provided via an electric cable run along the holding rope 2 and connected to the solenoid valve 23 in the casing 40. This eliminates the need to build the battery 24 into the casing 40 and thereby allows the main body of the device to be downsized.

Regarding the method for actuating the solenoid valve 23, instead of using radio commands, the solenoid valve 23 may be actuated by a timer connected to the solenoid valve 23 with an actuation time preset before a drop, by an acceleration sensor adapted to turn on a switch on impact at the time of a drop, or by turning on a switch adapted to make a wire connection by getting wet with water after a drop. Also, the solenoid valve may be replaced by a valve provided with a mechanism adapted to get released on impact at the time of a drop or a valve provided with a mechanism adapted to get released as a sealed portion becomes wet after a drop. In either case, the valve is actuated automatically without any particular command, causing the air chamber 10 to start inflating and thereby making it possible to prevent trouble caused by human operations or radio communications.

Figure 6:
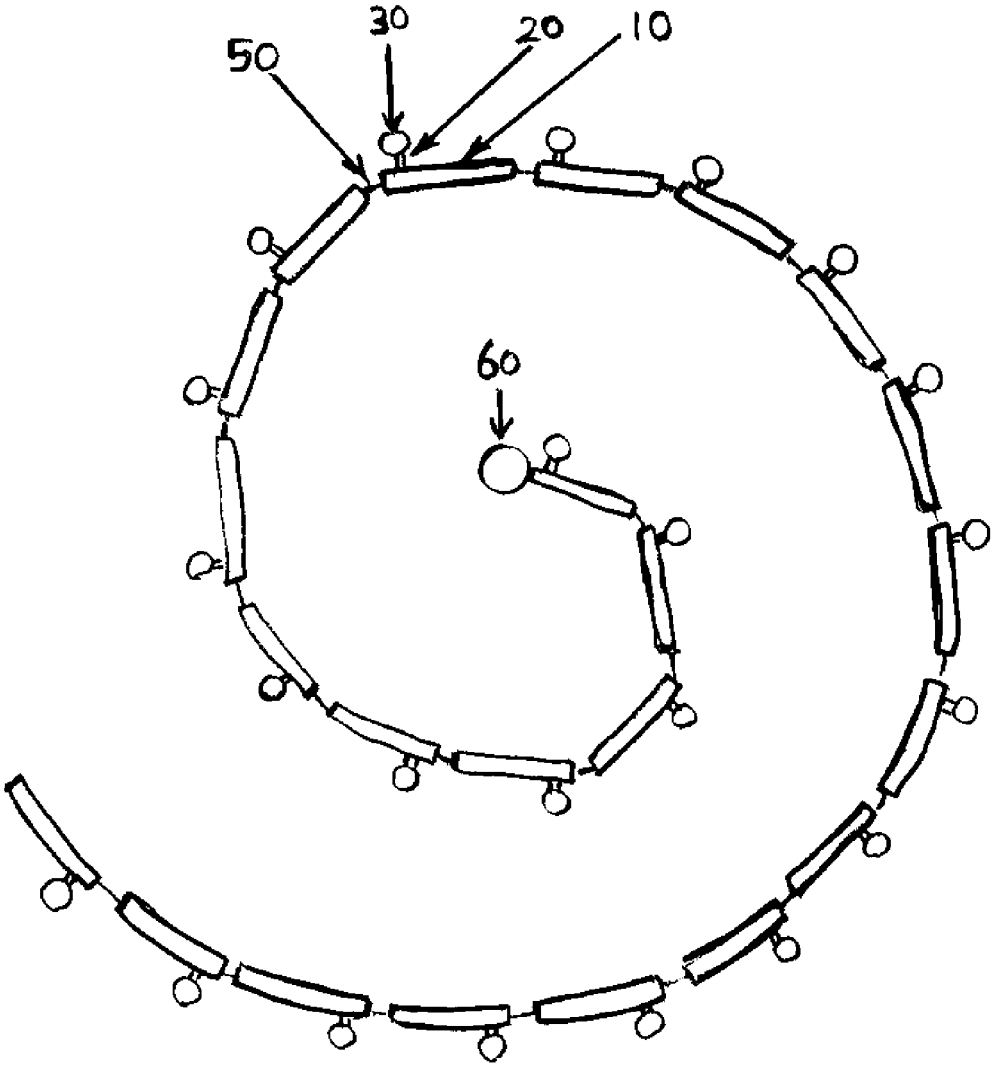
FIG. 6 is a plan view of an air chamber of a water rescue device according to a second embodiment of the present invention.

Next, a second embodiment of the present invention will be described with reference to drawings. FIG. 6 is a configuration diagram of a water rescue device 1 according to the second embodiment of the present invention, where the water rescue device 1 includes plural independent air chambers 10, a gas filling mechanism 20, a compressed gas cylinder 30, and a connecting member 50 adapted to connect the plural air chambers with each other. The connecting member 50 may be a rigid body made of metal or plastic; a non-rigid body such as a rope, cord, chain, ring, or coil; or an elastic body such as rubber. Also, the air chambers 10 and connecting member 50 may be connected pivotally or fixed to each other non-pivotally. Also, the shape of the air chamber 10 filled with gas may be a linear tubular shape, curved tubular shape, or sharply bent tubular shape. Furthermore, the shape of the connecting member 50, especially in the case of a rigid body, may be a linear shape, curved shape, or sharply bent shape. Note that the connecting member 50 may be made up of a continuous body, with the air chambers 10 attached thereto, rather than separate pieces. If the materials and shapes of the air chambers and the connecting member are selected appropriately, the air chambers and the connecting member can be deployed so as to form a spiral shape. In this way, the provision of plural independent air chambers 10 achieves the advantage of being able to reduce the size of the individual air chambers 10 as well as to reduce the gas filling time. Also, a float 60 may be connected to the first air chamber at the center of the spiral shape.

The water rescue device according to the present invention may be dropped from an airplane instead of a helicopter. Then, a rapid rescue operation can be expected than when a helicopter is used, and the feature of the present invention, i.e., the capability to deploy the water rescue device over a wide area, allows the air chambers to be deployed in the vicinity of rescuees in spite of a high flying speed.

Also, the water rescue device according to the present invention may be dropped from a ship. The water rescue device according to the present invention is useful when it takes time before a full-scale rescue operation by means of life boats.

Furthermore, the water rescue device according to the present invention can be thrown from land. For example, in saving rescuees swept away or isolated by a swollen river or the like, if the water rescue device according to the present invention is thrown from a riverbank or bridge, the air chambers can be deployed over a wide area, making it possible to reliably save the rescuees. Of course, the water rescue device according to the present invention can be used not only in rivers, but also in lakes, at the seaside, and in inundated zones at the time of a flood.

REFERENCE SIGNS LIST

1 Water rescue device
2 Holding rope
10 Air chamber
11 Linear portions making up the air chamber
20 Gas filling mechanism
23 Solenoid valve
30 Compressed gas cylinder
40 Casing
50 Connecting member
60 Float
H Helicopter

The invention claimed is:

1. A water rescue device, comprising:

an air chamber, which is configured to become hollow and tubular when filled with gas, and which a rescuee can hold on to;

a gas filling mechanism adapted to fill the gas into the air chamber; and a compressed gas cylinder adapted to compress and hold the gas, wherein the compressed gas from the compressed gas cylinder is filled into the air chamber by the gas filling mechanism, unfolding the air chamber into a spiral shape, wherein when inflated by being filled with gas, the air chamber has a hollow tubular shape with a substantially circular cross section and without a partition.

2. The water rescue device according to claim 1, further comprising a casing adapted to house the air chamber, the gas filling mechanism, and the compressed gas cylinder, wherein the air chamber is released from the casing when the casing which houses the air chamber, the gas filling mechanism, and the compressed gas cylinder, is dropped onto a water surface.

3. The water rescue device according to claim 1, wherein the air chamber is made up of linear portions, which are joined with each other by joining sections of adjoining linear portions having a predetermined angle, so that the air chamber may be maintained in the spiral shape when inflated.

4. A water rescue device comprising:

an air chamber, which is configured to become hollow and tubular when filled with gas, and which a rescuee can hold on to;

a gas filling mechanism adapted to fill the gas into the air chamber; and a compressed gas cylinder adapted to compress and hold the gas, wherein the compressed gas from the compressed gas cylinder is filled into the air chamber by the gas filling mechanism, unfolding the air chamber into a spiral shape, wherein the air chamber is constructed as a single space without any partition.

5. The water rescue device according to claim 4, further comprising a casing adapted to house the air chamber, the gas filling mechanism, and the compressed gas cylinder, wherein the air chamber is released from the casing when the casing which houses the air chamber, the gas filling mechanism, and the compressed gas cylinder, is dropped onto a water surface.

6. The water rescue device according to claim 4, wherein the air chamber is made up of linear portions, which are joined with each other by joining sections of adjoining linear portions having a predetermined angle, so that the air chamber may be maintained in the spiral shape when inflated.

* * * * *